US005921579A

United States Patent [19]

Sadler

[11] Patent Number: 5,921,579

[45] Date of Patent: Jul. 13, 1999

[54] DOUBLE-SIDED STAND-UP BOOK

[76] Inventor: Carolen Sadler, 30871 Driftwood, South Laguna, Calif. 92677

[21] Appl. No.: 09/094,264

[22] Filed: Jun. 9, 1998

[51] Int. Cl.[6] ..... B42D 3/06; B42D 3/18; B42D 1/00

[52] U.S. Cl. ..... 281/33; 283/107

[58] Field of Search ..... 281/33; 283/107

[56] References Cited

U.S. PATENT DOCUMENTS 1,099,775 6/1914 Smith ..... 281/33

4,058,327 11/1977 Sullivan et al. ..... 281/33

5,100,181 3/1992 Nathans et al. ..... 283/107

*Primary Examiner*—Willmon Fridie, Jr.

*Assistant Examiner*—Mark T. Henderson

*Attorney, Agent, or Firm*—Harry G. Weissenberger

[57] ABSTRACT

A spiral-bound stand-up book has pages printed with one set of textual materials on one side, and a second independent set of textual materials on the other so as to allow two persons looking at the book from opposite sides to simultaneously read two independent sets of textual materials.

3 Claims, 3 Drawing Sheets

DOUBLE-SIDED STAND-UP BOOK

FIELD OF THE INVENTION

This invention relates to children's books, and more particularly to a stand-up, childproof book which can be read simultaneously by two children seated opposite each other at a table.

BACKGROUND OF THE INVENTION

Children at breakfast table or the like often get bored with eating and search for a visual stimulation such as reading cereal box covers or watching television. Reading a conventional book, magazine or newspaper is impractical because it requires the use of the hands, which are needed for eating. Also, a conventional book or magazine can only be read by one child at a time when two children are seated opposite each other.

The problem of hand use has been addressed in the past by self-standing books such as certain Little Simon books published by Simon & Schuster of New York, or Tell Me About Books published by Random House. These books have a rigid back cover with hinged sections that fold out to form a stand that supports the book in an upright position. A spiral binding on the top side of the book when it is standing allows the pages to be flipped from the front to the rear of the book.

The prior art books have several disadvantages: for one, they are printed on only one side of the paper, because the back side of the page is hidden from the reader's view when the page is turned; secondly, the inside pages of the book, if coated at all, are coated against moisture and spillage only on the printed side; thirdly, the book can only be read from one side (i.e. by one reader) at a time; and finally, the book rests on its long side for stability, which makes for awkward reading to a child used to reading a book in the upright position.

SUMMARY OF THE INVENTION

The invention overcomes the problems of the prior art by providing a stand-up book which stands on its short side and is composed of spiral-bound pages bound at the top, wherein the pages are heavily coated and printed on both sides, with the textual material so arranged that the page fronts and the page backs constitute separate reading sequences. In this manner, two children seated opposite each other can read individually sequenced textual materials from the same book positioned in a hands-free manner between them.

DESCRIPTION OF THE PREFERRED EMBODIMENT

Figure 1A:
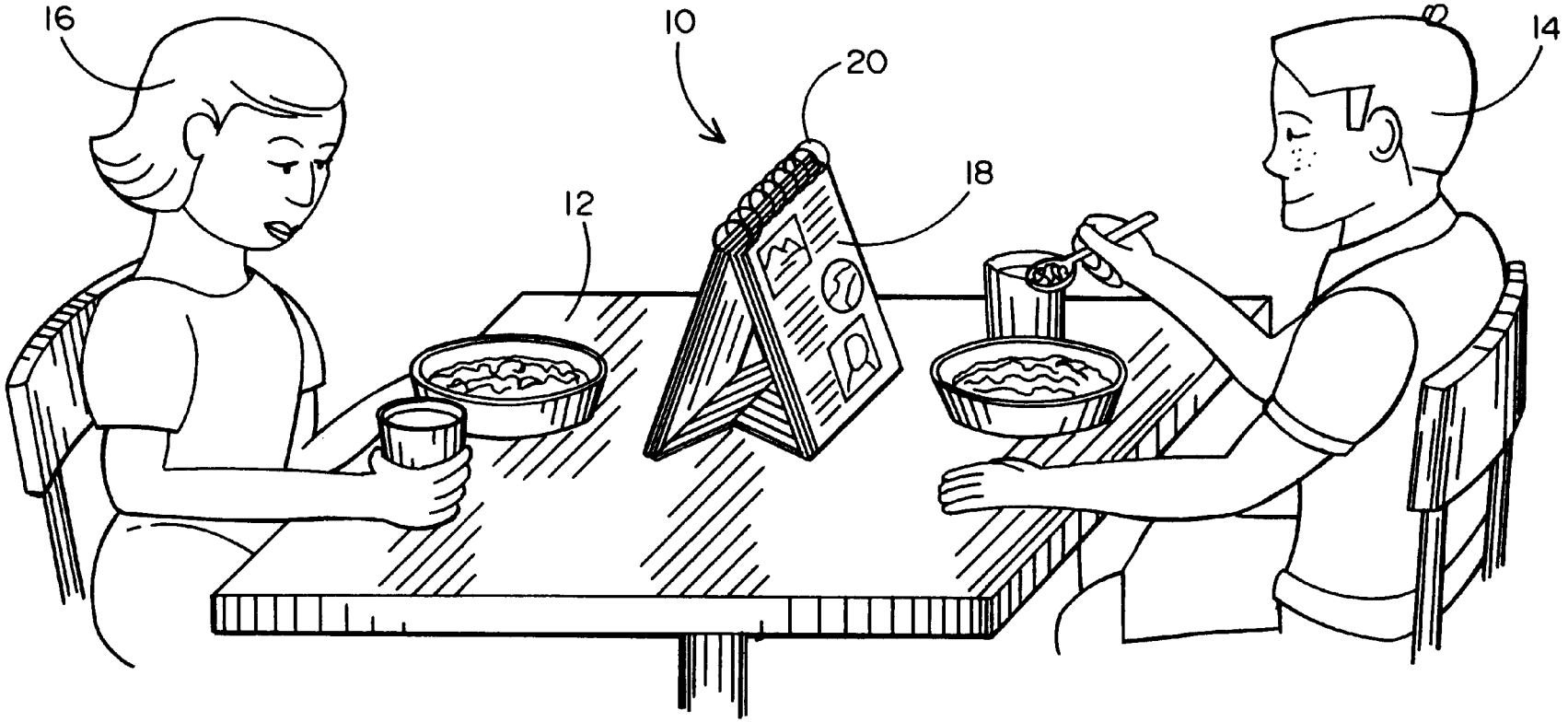
FIG. 1*a* is a perspective view of the book of this invention in use showing the book as seen by a first reader.
Figure 1B:
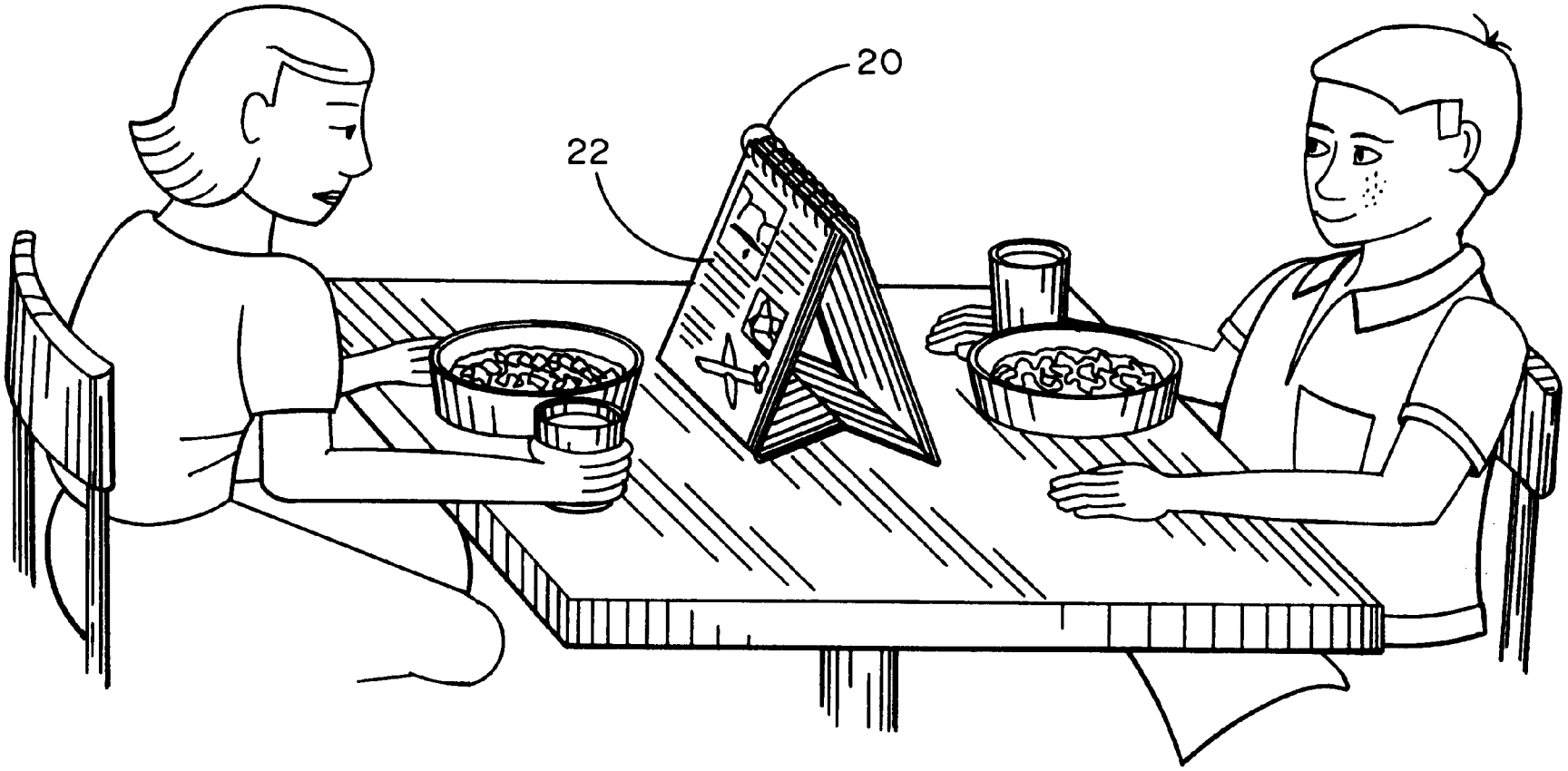
FIG. 1*b* is a perspective view of the book of this invention in use showing the book as seen by a second reader.

FIGS. 1*a* and 1*b* illustrate the concurrent use of the inventive book by two readers in the context of mealtime reading. The book 10 is placed on the table 12 in an upright position between a first reader 14 and a second reader 16. The first reader 14 sees the front 18 of each page as the pages are turned over the spiral binding 20, while the second reader 16 sees the back 22 of each page. Thus, unlike in an ordinary book in which the textual sequence of the book (e.g. a story) is continued from the front of each page to its back, the page fronts 18 and page backs 22 of the book 10 must contain separate sets of textual sequences, as the reader 14 will see only a succession of page fronts 18, and the reader 16 will see only a succession of page backs 22. Yet, as illustrated in FIGS. 1*a* and 1*b*, two readers can read different textual materials in the same book at the same time.

Figure 2:
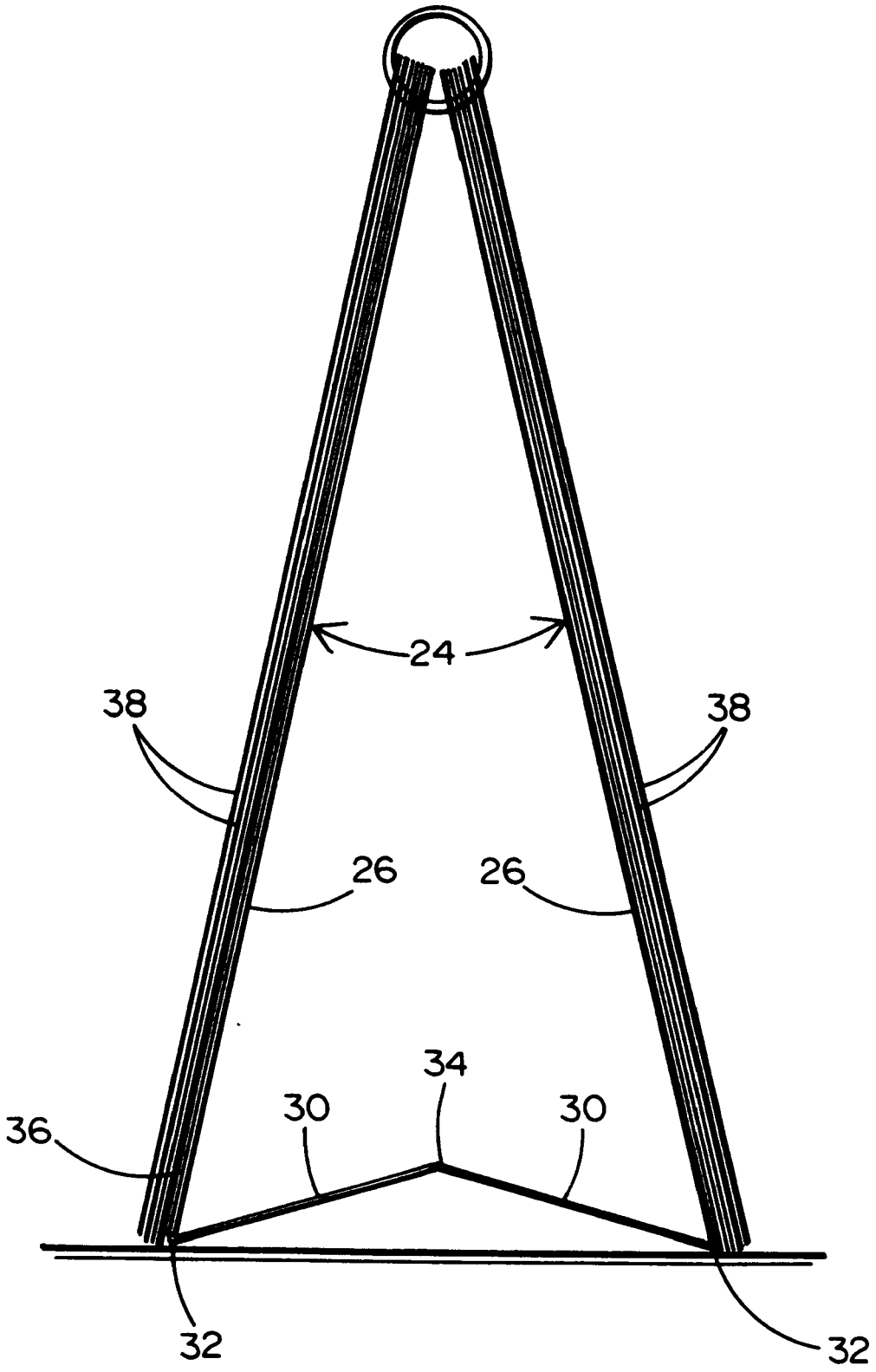
FIG. 2 is an end elevation of the book of this invention.

FIG. 2 illustrates the physical construction of the book of this invention. The book 10 has a rigid back cover 24 which has a W-shaped cross section. The outer legs 26 of the back cover 24 are joined at their upper ends by the spiral binding 20. The inner legs 30 are hinged to the outer legs 26 at 32 and to each other at 34. This allows the book 10 to be folded flat for storage, yet to be expanded by flattening the inner legs 30 so as to stand on the table 12 without assistance.

The book 10 also preferably has a rigid front cover 36 (shown folded over against the rear of the back cover 24 in FIG. 2) to protect the pages 38 when the book 10 is not in use. The pages 38 may be rigid or flexible, depending on the age of the readers, but in any event they are preferably coated on both sides with a heavy varnish or plastic covering that is workable and water- and food-resistant.

In order to minimize the lateral extent of the book when in use, so as to maximize visibility between the opposing readers and give the book 10 a more natural appearance, the spiral binding 20 is placed on the short side of a typical rectangular book.

It is understood that the exemplary double-sided stand-up book described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A book for simultaneous hands-free use by readers on opposite sides of a table, comprising:

a) a back cover including a pair of substantially rigid, substantially rectangular outer legs joined at their bottom by a pair of inner legs hingeably joined to said outer legs and to each other, said back cover being arranged to fold between a flat position for storage and an expanded position adapted to support said book uprightly on a horizontal surface with the short side of said outer legs contacting said horizontal surface; and b) a set of pages having a first set of textual materials on their front and a second, independent set of textual materials on their back;

c) said pages and back cover being joined along their top edges by a spiral binding arranged to provide a pivot axis about which said pages can be pivoted from a position wherein they are parallel to one face of said back cover to a position wherein they are parallel to the other face of said back cover when said back cover is expanded.

2. The book of claim 1, further comprising a protective front cover which is also pivotable about said pivot axis from a position covering the front of said book to a position parallel to said other face of said back cover.

3. The book of claim 1, in which said pages are coated to be resistant to moisture and food materials.

* * * * *